US007101244B2

(12) United States Patent
Kamiguchi

(10) Patent No.: US 7,101,244 B2
(45) Date of Patent: Sep. 5, 2006

(54) METHOD FOR MANUFACTURING AIRTIGHT CONTAINER, METHOD FOR MANUFACTURING IMAGE DISPLAY APPARATUS, AND AIRTIGHT CONTAINER AND IMAGE DISPLAY APPARATUS

(75) Inventor: Kinya Kamiguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 10/647,343

(22) Filed: Aug. 26, 2003

(65) Prior Publication Data

US 2004/0130259 A1 Jul. 8, 2004

(30) Foreign Application Priority Data

Aug. 28, 2002 (JP) ..... 2002-248839
Aug. 20, 2003 (JP) ..... 2003-296258

(51) Int. Cl.
*H01J 9/24* (2006.01)
*H01J 9/40* (2006.01)

(52) U.S. Cl. ..... 445/24; 445/25

(58) Field of Classification Search ..... 313/495–497; 445/24, 25

See application file for complete search history.

(56) References Cited

U.S. PATENT DOCUMENTS

| | | | | |
|---|---|---|---|---|
| 6,114,804 | A * | 9/2000 | Kawase et al. | 313/495 |
| 6,407,500 | B1 * | 6/2002 | Tsuburaya et al. | 313/495 |
| 6,603,255 | B1 * | 8/2003 | Takahashi | 313/496 |
| 2003/0025443 | A1 | 2/2003 | Kamiguchi | 313/495 |
| 2003/0141796 | A1 | 7/2003 | Kamiguchi | 313/281 |

FOREIGN PATENT DOCUMENTS

| | | |
|---|---|---|
| JP | 5-114372 | 5/1993 |
| JP | 9-45266 | 2/1997 |
| JP | 2000-195449 | 7/2000 |

* cited by examiner

*Primary Examiner*—Mariceli Santiago
(74) *Attorney, Agent, or Firm*—Fitzpatrick, Cella, Harper & Scinto

(57) ABSTRACT

Methods for manufacturing an airtight container and an image display apparatus. To enable supplying of a potential to an electrode in the airtight container, the container is constructed to include a structure having a concave portion opened at a through-hole of a substrate and closed at the bottom, and a shape is formed in which by applying a pressure difference between the inside and the outside of the container, the structure is deformed to enable supplying of a potential to the electrode.

5 Claims, 10 Drawing Sheets

METHOD FOR MANUFACTURING AIRTIGHT CONTAINER, METHOD FOR MANUFACTURING IMAGE DISPLAY APPARATUS, AND AIRTIGHT CONTAINER AND IMAGE DISPLAY APPARATUS

BACKGROUND OF THE INVENTION

1. Field of the Invention

The present invention relates to an airtight container, and an image display apparatus which uses the same. The invention relates to an airtight container in which the inside is maintained in a lower pressure state than the outside.

2. Related Background Art

In recent years, a color cathode ray tube (CRT) has been used in wide as an image display apparatus. However, since a driving principle is a system of deflecting an electron beam from a cathode, and emitting a light from a phosphor on a screen, a depth must be set in accordance with a screen size. As a screen is enlarged, a depth is made longer, which creates problems of increases in installation space and weight etc. Therefore, there is a strong demand for a planar image display apparatus which can be made thin and light. As examples of planar image display apparatus, there are an electron emission display panel of a surface conductive type (referred to as SED hereinafter) (Japanese Patent Application Laid-Open No. H09-045266), and a field emission display apparatus (referred to as FED hereinafter) (Japanese Patent Application Laid-Open No. H05-114372).

FIG. 11 shows in outline the planar image display apparatus described in Japanese Patent Application Laid-Open No. H05-114372. A front panel 2 on which a power supply conductive layer 6 is formed as an anode electrode, a back panel 3 on which a cathode electrode 7 is disposed, and an insulating layers 8, 28 are pinched in, and sealed. Then, an atmosphere is sucked out of the inside through an exhaust pipe (not shown in the figures) by a pump, sealing is applied, and a vacuum structure is formed. Accordingly, a superthin planar display apparatus 20 is manufactured. A voltage is applied between the power supply conductive layer 6 and the cathode electrode 7 to emit electrons from the cathode electrode 7. By the emitted electrons, a light is emitted from a fluorescent screen to form a pixel, and an image is displayed on the front panel 2. At this time, in order to apply a voltage to the power supply conductive layer 6, a fluorescent screen potential power supply terminal 16, an elastic body 19 and the power supply conductive layer 6 are used through a terminal lead-out section 17 from a hole 15 bored in the back panel 3. Therefore, vacuum-sealing of a seal body 18 which covers the terminal lead-out section is necessary.

Japanese Patent Application Laid-Open No. 2000-195449 discloses a vacuum container used in an image display apparatus. FIG. 16 of this publication shows a constitution in which an elastic spring member is deformed by a vacuum force, and a high-pressure introduction terminal is directly pulled out to be connected on a wiring.

SUMMARY OF THE INVENTION

Objects of the present invention are to provide 1) a novel method for manufacturing an airtight container having an electrode inside, which can easily realize a constitution of supplying a potential to the electrode, 2) a low-cost airtight container, and 3) a low-cost image display apparatus.

One of the manufacturing methods of airtight containers of the present invention is constituted as follows.

That is, according to one aspect of the present invention, there is provided a method for manufacturing an airtight container having a space in which a pressure is lower than the outside, between opposing first and second substrates, comprising steps of:

assembling the container having the space between the first and second substrates, the first substrate in which an electrode is disposed on a surface as the space side and the second substrate which has a structure for supplying a potential to the electrode being opposite each other; and applying a pressure difference between the inside and the outside of the container assembled in the above step, wherein in the container before the pressure difference application step, the structure has a concave portion which is opened to an external atmosphere at a through-hole penetrating the second substrate and closed at the bottom, and the pressure difference is brought in the pressure difference application step to elongate lengths of the structure in direction in which the first and second substrates are opposed, whereby the structure is formed in a shape to enable supplying of a potential to the electrode through the structure.

In the structure, the portion elongated by the pressure difference may be formed to be elastic, and this elasticity easily brings temporary or permanent narrowing of a gap between the first and second substrates after the pressure difference application step. Not limited to this, however, the portion may be plastically deformed by the pressure difference to be elongated.

The assembling step can be optionally executed. However, as an example, a constitution can be suitably employed where the assembling step has a step of preparing the first substrate in which the electrode is formed, and a step of preparing the second substrate in which the structure is disposed, and a step of arranging the first and second substrates oppositely to each other to bond them. A member may be arranged between the first and second substrates to maintain a gap therebetween. As such a member, a frame arranged to surround the internal space, or a spacer disposed in a proper position in the internal space, an outer periphery of which is defined, can be cited.

The shape to enable supplying of a potential to the electrode through the structure means that if it is connected to an external potential supply circuit to supply a potential to the structure, the potential is supplied to the electrode through the structure. If the pressure difference application step is executed while the potential is supplied to the structure, potential supplying is carried out at a point of time when the structure becomes a shape to enable supplying of a potential to the electrode through the structure.

For the pressure difference application step, a process can be suitably employed where the container is assembled to enable a pressure reduction inside through a ventilation section such as an exhaust pipe in the assembling step, the airtight container is constituted by executing the step of applying a pressure difference by degassing the inside through the ventilation section after the assembling step and executing the assembling step in a pressure-reduced atmosphere, and then the step of applying the pressure difference is executed by exposing the container to a higher pressure atmosphere.

One of the other inventions is constituted as follows. That is, according to another aspect of the present invention, there is preferable, a method for manufacturing an airtight container having a space in which a pressure is lower than the outside, between opposing first and second substrates, comprising steps of:

assembling the container having the space between the first substrate in which an electrode is disposed on a surface as the space side and the second substrate which has a structure for supplying a potential to the electrode being opposite each other; and applying a pressure difference between the inside and the outside of the container assembled in the above step, wherein in the container before the pressure difference application step, the structure has a surface of a curved shape between a portion bonded to the second substrate and a portion to be brought into direct or indirect contact with the electrode, and the pressure difference is brought between the inside and the outside of the surface of the curved shape in the pressure difference application step to deform the surface, whereby the structure is formed in a shape to enable supplying of a potential to the electrode through the structure.

The curved shape can be formed by pressing work to bend a noncurved shape or the like. However, it is not limited to the shape formed by bending the solid member of the noncurved shape. For example, a structure having a curved shape may be manufactured by casting. The surface having the curved shape includes a surface which has a folded shape. The folded shape is not limited to the shape formed by folding an unfolded shape. For example, a folded shape realized by bonding a plurality of members is included. As one of such curved shapes, a bellows-like configuration can be cited. This configuration can be formed by using pressing work as bending work, or alternately bonding inner and outer diameter ends of a plurality of ring-shaped members.

Preferably, the portion to be brought into direct or indirect contact with the electrode and the portion to be deformed of the structure are formed by bending one plate member, and use of press working as bending work is especially preferable. More preferably, the portion to be brought into direct or indirect contact with the electrode, the portion to be deformed, and the portion of the structure bonded to the second substrate are formed by bending one plate member.

The whole structure which supplies the potential to the electrode disposed in the first substrate, or a part thereof which becomes a potential supply path is preferably constituted of a conductor. A metal (including alloy) can be suitably used for the conductor. In the case of forming a plurality of portions by being one plate member as in the above, a metal plate is preferably used as the plate member.

The manufacturing method of the airtight container of the present invention can be suitably used for manufacturing an image display apparatus which has the airtight container.

Specifically, it is advised to implement the manufacturing method of the airtight container after an electrode for constituting an image display device or an image forming device is formed beforehand in one of the first and second substrates or in a position on the internal space side of both.

An airtight container of the present invention is constituted as follows.

That is, according to a further aspect of the present invention, there is provided an airtight container comprising:

a first substrate in which an electrode is disposed;

a second substrate which is opposite the electrode-disposed surface of the first substrate; and a structure which is bonded to the second substrate, and brought into direct or indirect contact with the electrode to supply a potential to the electrode, wherein in the structure, a portion deformed by a lower pressure in an internal space between the first and second substrates than a pressure of an external atmosphere and a portion brought into direct or indirect contact with the electrode are formed by bending one plate member.

The bonding of the structure to the second substrate may be executed directly or indirectly to the substrate.

The structure may be brought into contact with the electrode directly or indirectly through a metal (including alloy) more flexible than the electrode. Additionally, the structure may be bonded by a conductive adhesive. As the adhesive, preferably, a constitution in which the structure is bonded to the electrode by using a molten metal in a solid form is employed.

An airtight container of the other invention is constituted as follows.

That is, according to still another aspect of the present invention, there is provided an airtight container comprising:

a first substrate in which an electrode is disposed;

a second substrate which is opposite the electrode-disposed surface of the first substrate; and a structure which is bonded to the second substrate, and brought into direct or indirect contact with the electrode to supply a potential to the electrode, wherein the structure is bonded to a surface of the second substrate opposite the first substrate at a through-hole penetrating the second substrate, and the structure has a concave portion which is opened at the through-hole to an external atmosphere to an internal space formed between the first and second substrates and closed at the bottom, and a portion in which a surface opposite a surface bonded to the second substrate is exposed to the external atmosphere as a portion bonded to the surface of the second substrate opposite the first substrate.

According to a further aspect of the present invention, there is provided an image display apparatus which comprises: the airtight container of the invention; and an image display device arranged in the airtight container.

As the image display device, for example, an electron emitting element can be suitably used. In the case of using the electron emitting element as the image display device, a phosphor which emits a light by electrons emitted from the electron emitting element may be further arranged. As an example, a constitution can be suitably employed where the electron emitting element is disposed in one of the first and second substrates, and the phosphor is arranged in the other substrate. In the case of using the electron emitting element, a constitution can be suitably employed where an electrode to which an acceleration potential for accelerating emitted electrons is arranged inside. As the electrode disposed in the first substrate of the present invention, the electrode to which the acceleration potential is supplied or a drawer electrode drawn out of the electrode can be cited. In this case, the structure may be arranged to supply the acceleration potential to the electrode. The image display device is not limited to the above constitution, but an electroluminescence device, a plasma cell to constitute a plasma display etc., can be employed.

PREFERRED EMBODIMENTS OF THE INVENTION

Figure 1:
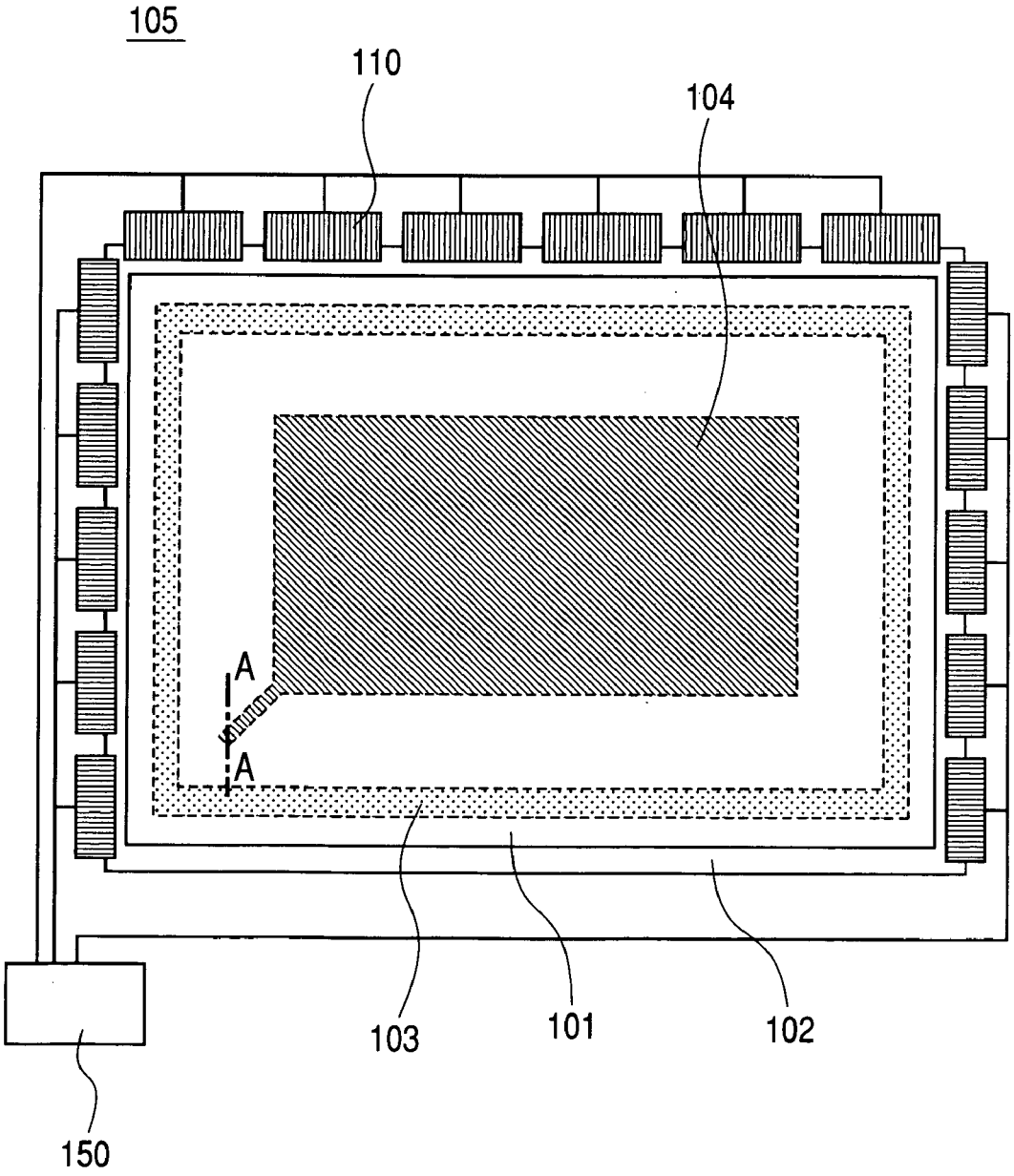
FIG. 1 is a schematic plan view showing an embodiment of an image display apparatus.
Figure 2:
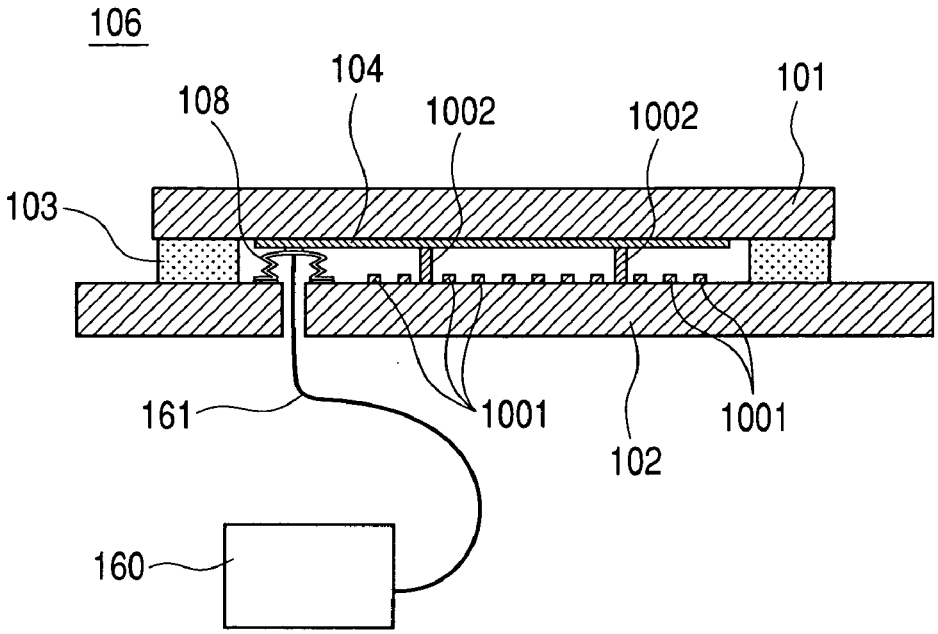
FIG. 2 is a schematic partial sectional view showing an embodiment of a vacuum container of the present invention.

FIGS. 1 and 2 show in outline a first embodiment of the present invention. An airtight container 106 can be manufactured by arranging a face plate 101 comprising an anode 104 on a plane and a rear plate 102 comprising a cathode 1001 on a plane oppositely to each other, pinching in a frame 103 and a spacer 1002 therebetween, and bonding the plates. The cathode 1001 is an electron emitting element which is an image display device, and electrons emitted from the electron emitting element are accelerated by an acceleration potential applied to the anode which is an acceleration electrode. This airtight container is a vacuum container which is set to $10^{-4}$ Pa or lower inside (airtight container is referred to as a vacuum container, hereinafter). By holding the cathode in the vacuum container, the cathode can function as an electron source. In the vacuum container, a drawer wiring (not shown) is laid from the cathode in the vacuum container on the rear plate 102, and extended to the outside of the frame 103. The cathode is controlled by a driving device 150 through a drawer cable 110 which is made electrically conductive by a trailing end of the drawer wiring. The anode is controlled by a voltage supplying device 160 through a voltage supplying structure 100 which includes a later-described structure of the present invention, and a voltage supplying cable 161 attached to the voltage supplying structure by a connector (not shown). A potential applied from the voltage supplying device 160 is supplied to the structure, and supplied through the structure to the anode which is an acceleration electrode. Then, by controlling the cathode and the anode in the vacuum container 106 in such a manner, an image can be formed in an image display apparatus 105. The face plate 101 and the rear plate 102 respectively constitute first and second substrates, which can be made of, e.g., glass. A pressure inside the vacuum container of the image display apparatus 105 is lower than an external atmosphere, i.e., the inside is in a vacuum state. The face plate 101, the rear plate 102 and the frame 103 are bonded by frit glass or the like to maintain airtightness between the face plate 101 and the rear plate 102. In the image display apparatus 105, a voltage is applied to the anode 104 to accelerate electrons which are out of the cathode (not shown) on the rear plate 102 into vacuum, and the electrons collide with a phosphor in the anode 104 to emit a light, thereby forming an image.

Figure 3:
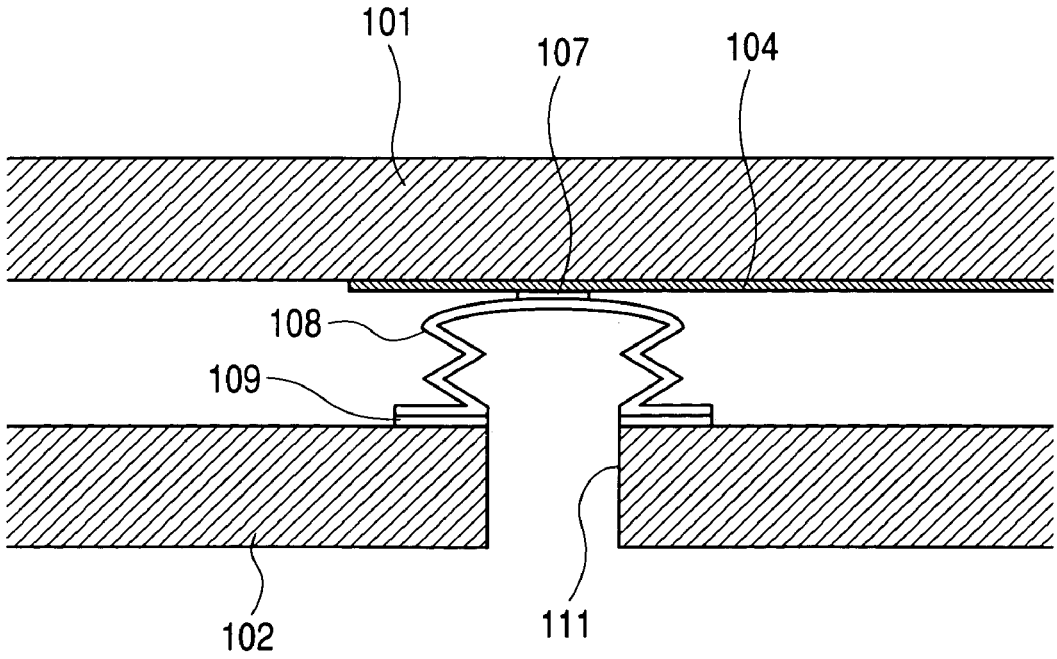
FIG. 3 is a schematic partial sectional view showing an example of a voltage supplying structure.

As a power supplying system from an atmosphere to the image display apparatus 105 which is vacuum inside, the voltage supplying structure 100 is provided. The image display apparatus 105 comprises the aforementioned vacuum container in which the face plate 101, the rear plate 102 and the frame 103 are bonded and which comprises the voltage supplying structure 100, the drawer cable 110, the driving device 150, the voltage supplying cable 161, and the voltage supplying device 160. FIG. 3 is a partial sectional view cut along the line A—A of FIG. 1. A voltage is applied from the backside of the rear plate 102 through a throughhole (referred to a hole hereinafter) 111 to a conductive member 108, and applied through a low melting point material 107 to the anode 104. A diameter of the hole is about 2 mm.

The structure of the present invention is constituted of the conductive member 108. The conductive member 108 has, as a portion to be elongated by a pressure difference, a bellows-like portion which especially has a curved shape, a portion connected to the anode, and a portion bonded to the rear plate 102. The voltage supplying structure 100 comprises the conductive member 108, the low melting point material 107, and a bonding member 109.

The conductive member 108 can be brought into direct contact with the anode 104. Preferably, however, the low melting point material 107 is disposed therebetween. The low melting point material is used as a member to improve conductivity by enhancing adhesion between the conductive member 108 and the anode 104. The low melting point material is compressed and deformed between the conductive member 108 deformed by an atmospheric pressure and the anode 104, stuck to the surface shape of the conductive member 108 and the anode 104, and thus capable of improving electrical conductive reliability. At this time, for the low melting point material 107, a conductive material which has a solidus temperature of 100° C. or higher as a standard product use temperature, and a melting point of a temperature 420° C. or lower to manufacture the vacuum container can be properly selected. For example, a low melting point metal material can be used. The low melting point metal is used as the member to improve electrical connection between the conductive member 108 and the anode. For this member, however, a member softer than the anode is preferably used. This member may be used as a binding material to bond the conductive member 108 and the anode 104.

When the image display apparatus 105 is influenced by an unexpected surrounding temperature to be deformed by thermal expansion, adhesion between the conductive member 108 and the anode 104 may be deteriorated. In such a case, by applying a high-frequency voltage to the conductive member 108, and generating heat to melt the low melting point material 107, it is possible to improve adhesion between the conductive member 108 and the anode 104 without disassembling the image display apparatus 105. The molten low melting point material is solidified by a reduction in temperature to become a member to bond the conductive member 108 and the anode 104.

Vacuum airtightness is secured by using a bonding member 109 to bond the conductive member 108 and the anode 104. As a material of the bonding member 109, for example, a frit which is low melting point glass is used. A mixture of a frit and a solvent is applied on the conductive member 108 by a dispenser, dried (e.g., 120° C., 10 min.), and temporary burning (e.g., 360° C., 10 min.) is carried out. Then, in a real burning step (e.g., 420° C., 30 min.), the conductive member 108 is placed on the rear plate 102, and a load is applied on the conductive member 108 to crush the temporarily burned frit while a temperature is increased. Thus, good bonding is obtained.

The conductive member 108 is an integral member constituted of an adhesive portion bonded to the rear plate, an elongation portion, and a contact portion brought into contact with the anode through the low melting point metal. As a material, in order to reduce thermal stress during manufacturing, it is advised to select a material of a thermal expansion coefficient which roughly coincides with that of a material used for the rear plate 102. For example, if glass of a thermal expansion coefficient $8.0\times10^{-6}$/° C. to $9.0\times10^{-6}$/° C. is used for the rear plate, a thermal expansion coefficient of the conductive member is preferably $7.5\times10^{-6}$/° C. to $1.0\times10^{-5}$/° C. The conductive member 108 is bonded to the rear plate 102 by the bonding member 109. Since only one place between the conductive member 108 and the rear plate 102 is a bonded portion of the voltage supplying structure 100, it is possible to limit a probability of leakage or a strength reduction caused by bonding failures. The conductive member 108 can be manufactured by, for example, sucking a plate made of a conductive material in a mold by air, and executing press-molding.

Figure 4A:
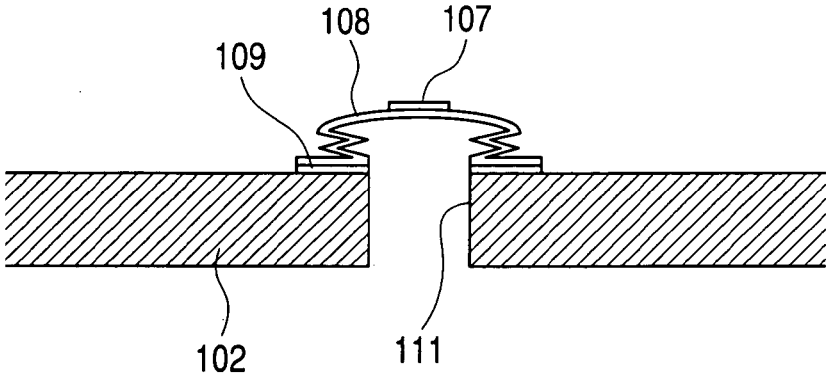
FIGS. 4A, 4B and 4C are process views showing a manufacturing method of the voltage supplying structure shown in FIG. 3.
Figure 4B:
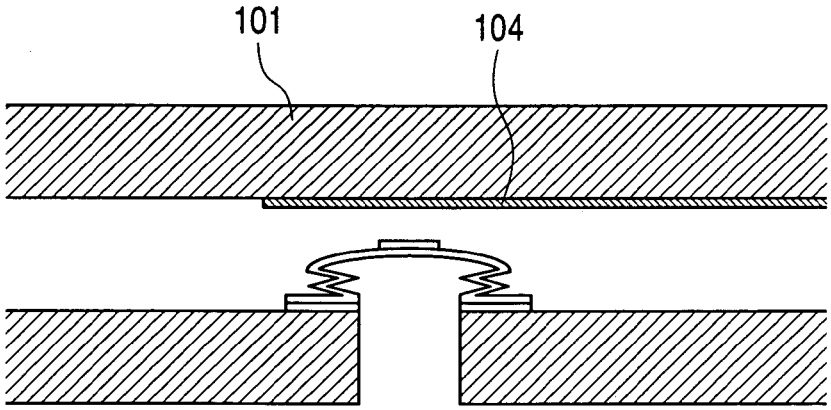
Figure 4C:
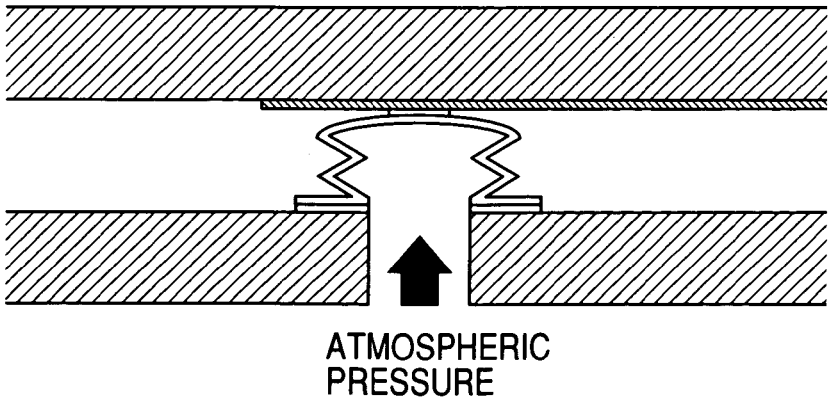

A height of the conductive member installed in the rear plate 102 from its upper surface can be made smaller than a gap between rear plate 102 and the face plate 101. As shown in FIG. 4A, the conductive member 108 is bonded to the rear plate 102 by the bonding member 109. Then, as shown in FIG. 4B, the frame is pinched in between the rear plate 102 and the face plate 101, and the rear plate and the frame, and the frame and the rear plate are sealed from each other by frits or the like. Then, a vacuum is drawn through the not-shown exhaust pipe between the rear plate 102 and the face plate 102, sealing is applied, and accordingly a vacuum container of the image display apparatus is manufactured. At this time as shown in FIG. 4C, since the conductive member 108 is formed in a shape which has a concave portion opened to an external atmosphere at a hole 111 as a through-hole of the rear plate, and closed at the bottom, i.e., the anode side, it is influenced by a pressure difference between an atmospheric pressure from the hole 111 and a pressure in the internal space to elongate even a gap length between the rear plate 102 and the face plate 101, and it is brought into indirect contact with the anode 104 through the low melting point material 107. Thus, a shape can be realized which enables supplying of a potential to the anode as an electrode formed in the face plate 101 from the rear plate side through the conductive member 108. When a potential is supplied to the conductive member 108 in this state, the potential is supplied through the conductive member 108 to the anode.

As the conductive member to constitute the structure of the present invention, the portion brought into contact with the anode, the elongated portion and the portion bonded to the rear plate are formed by deforming one plate member. Accordingly, a seal bonding interface of the hole 111 sealing can be limited to one place, and a probability of bonding failures or leakage can be made small. As a result, yield of the vacuum container 106 and the image display apparatus 105 can be increased, and a more inexpensive image display apparatus 105 can be provided. The structure before the application of the pressure difference is formed in a shape which has a concave portion opened to the external atmosphere at the hole 111 and closed at the bottom, i.e., the anode side. Thus, the side of the concave portion can be used as an elongated portion, and a sufficient length to be elongated can be set. Furthermore, by employing the structure of a curved shape as an elongated scheduled portion before the application of the pressure difference, a sufficient length to be elongated can be set.

EXAMPLES

Example 1

An image display apparatus of a type shown in FIG. 1 is manufactured, which has a voltage supplying structure shown in FIG. 3, and a vacuum container which is shown in FIGS. 1 and 2 and which comprises the voltage supplying structure.

An airtight container 106 is manufactured by arranging a face plate 101 comprising an anode 104 on a plane and a rear plate 102 comprising a cathode 1001 on a plane oppositely to each other, pinching in a frame 103 and a spacer 1002 therebetween, and bonding the plates. In this vacuum container, a drawer wiring (not shown) is laid from the cathode in the vacuum container on the rear plate 102, and extended to the outside of the frame 103. The cathode is controlled by a driving device 150 through a drawer cable 110 which is made electrically conductive by a trailing end of the drawer wiring. The anode is controlled by a voltage supplying device 160 through a voltage supplying cable 161 attached to the voltage supplying structure 100 by a connector (not shown). Then, controlling of the cathode and the anode in the vacuum container 106 in such a manner is enabled to constitute an image display apparatus 105. The face plate 101 and the rear plate 102 are made of glass of 2.8 mm in thickness. The inside of the image display apparatus is in a vacuum state. Frits (not shown) are used to bond the face plate 101, the rear plate 102 and the frame 103. Frit paste in which a frit is made claylike by a solvent is applied on the frame 103, dried, burning is carried out in an oven at 420° C. for 30 min., while a pressure is applied, and then bonded. By such bonding, airtightness is maintained between the face plate 101 and the rear plate 102. In the image display apparatus 105, a voltage is applied to the anode 104 to accelerate electrons which are out of the cathode on the rear plate 102 into vacuum, and the electrons collide with a phosphor (not shown in the figures) in the anode to emit a light, thereby forming an image.

As a power supply mechanism from an atmosphere to the image display apparatus 105 which is vacuum inside, the vacuum container 106 has the voltage supplying structure 100. FIG. 3 is a partial sectional view cut along the line A—A of FIG. 1. A voltage is applied from the backside of the rear plate 102 through a hole 111 to a conductive member 108, and applied through a low melting point material 107 to the anode 104.

The voltage supplying structure 100 comprises the conductive member 108, the low melting point material 107, and a bonding member 109. A diameter of the hole 111 bored in the rear plate is 2 mm.

The low melting point material 107 is disposed between the conductive member 108 and the anode 104. The low melting point material improves conductivity by enhancing adhesion between the conductive member 108 and the anode 104. As a low melting point material, an In alloy (melting point 140 to 200° C.) of a low melting point metal material is used. The low melting point material is compressed and deformed between the conductive member 108 deformed (elongated) by an atmospheric pressure and the anode 104, stuck to the surface shape of the conductive member 108 and the anode 104 (FIG. 4C), and thus capable of improving electrical conductive reliability.

Further, when the image display apparatus 105 is influenced by an unexpected surrounding temperature to be deformed by thermal expansion, adhesion between the conductive member 108 and the anode 104 may be deteriorated. In such a case, by applying a high-frequency voltage to the conductive member 108, and generating heat to melt the low melting point material 107, it is possible to improve adhesion between the conductive member 108 and the anode 104 without disassembling the image display apparatus 105.

Vacuum airtightness is secured by using a bonding member 109 to bond the conductive member 108 and the anode 104. As a material of the bonding member 109, a frit which is low melting point glass is used. A mixture of a frit and a solvent is applied on the conductive member 108 by a dispenser, dried (e.g., 120° C., 10 min.), and temporary burning (e.g., 360° C., 10 min.) is carried out. Then, in a real burning step (e.g., 420° C., 30 min.), the conductive member 108 is placed on the rear plate 102, and a load is applied on the conductive member 108 to crush the temporarily burned frit while a temperature is increased. Thus, good bonding is obtained.

The conductive member 108 is an integral member constituted of an adhesive portion of a diameter 4 mm and an elongation portion. A material is a 42Ni-6Cr—Fe alloy (thermal expansion coefficient $8.5\times10^{-6}$/° C. to $9.8\times10^{-6}$/° C.). The thermal expansion coefficient is roughly matched with that of glass used for the rear plate 102 (thermal expansion coefficient $8.0\times10^{-6}$/° C. to $9.0\times10^{-6}$/° C.) to reduce thermal stress during manufacturing. The conductive member 108 is bonded to the rear plate 102 by the bonding member 109. Since only one place between the conductive member 108 and the rear plate 102 can be a bonded portion of the voltage supplying structure 100, it is possible to limit a probability of leakage or a strength reduction caused by bonding failures.

The conductive member 108 is manufactured by sucking a plate of about 10 mm in diameter and 0.05 mm in thickness in a mold by air, and executing press-molding. A shape is a circle of an outer diameter of about 4 mm when the image display apparatus 105 is seen from the anode 104 side. A height is about 0.7 mm, which is smaller than a gap length 2 mm between the rear plate 102 and the face plate 101. As shown in FIG. 4A, the conductive member 108 is bonded to the rear plate 102 by the bonding member 109. Then, as shown in FIG. 4B, the frame 103 is pinched in between the rear plate 102 and the face plate 101, and the rear plate and the frame, and the frame and the rear plate are sealed from each other by frits. Then, a vacuum is drawn through the not-shown exhaust pipe between the rear plate 102 and the face plate 102, sealing is applied, and accordingly a vacuum container is manufactured. At this time as shown in FIG. 4C, the conductive member 108 is elongated to the gap length 2 mm between the rear plate 102 and the face plate 101 by a pressure difference between an atmospheric pressure from the hole 111 and a pressure in the internal space. That is, by the application of the pressure difference, the shape of the conductive member 108 which is a structure is deformed in a shape to be brought into contact with the anode 104 through the low melting point 107.

By disposing a plurality of concave and convex shapes in the elongation section on the side face of the conductive member 108 by press-molding, it is possible to control deformation of the conductive member 108 by the atmospheric pressure in a direction of the anode 104. As a result, it is possible to improve conductive reliability between the conductive member 108 and the anode 104.

Example 2

A vacuum container and an image display apparatus of the embodiment are roughly similar to those of the Example 1. However, the voltage supplying structure is changed to a structure shown in FIG. 5.

Figure 5:
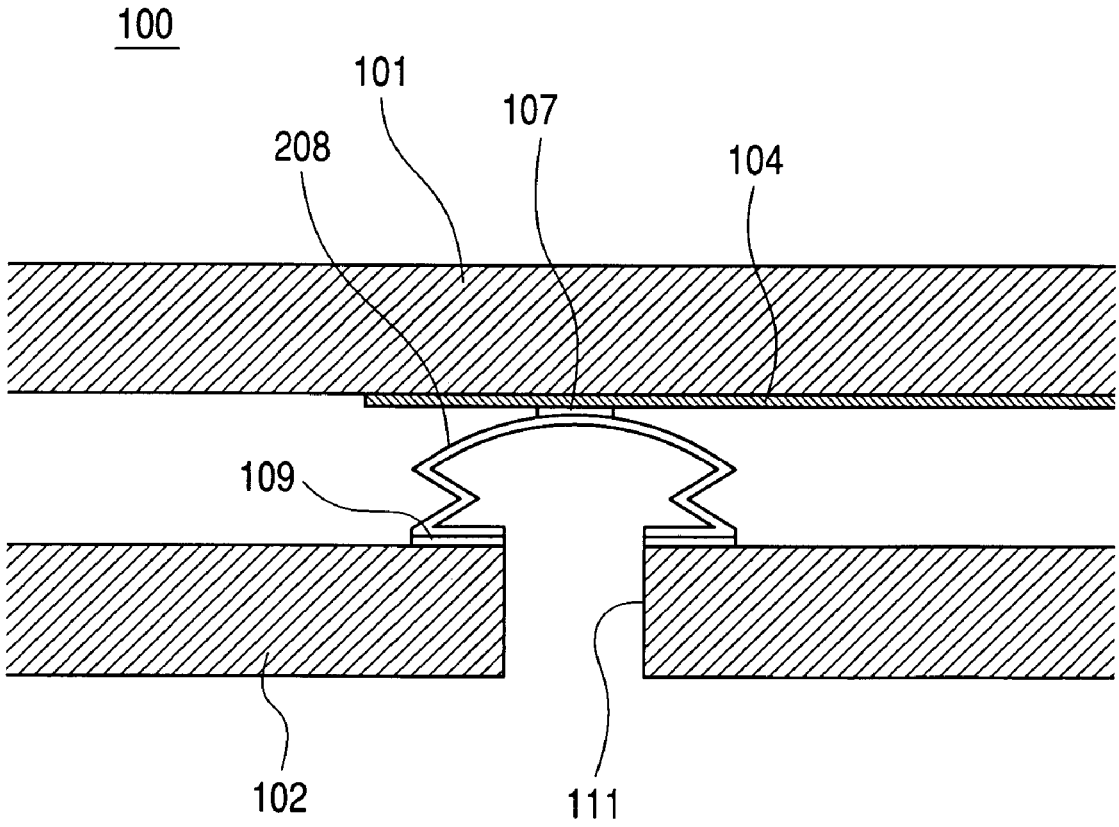
FIG. 5 is a schematic partial sectional view showing a voltage supplying structure of a second embodiment.

As a power supply mechanism from an atmosphere to the image display apparatus 105 which is vacuum inside, a voltage supplying structure 100 is provided. FIG. 5 is a sectional view of Example 2, which is equivalent to the line A—A portion of FIG. 1. A voltage is applied from the backside of a rear plate 102 through a hole 111 to a conductive member 208, and applied through a low melting point material 107 to an anode 104.

The voltage supplying structure 100 comprises the conductive member 208, the low melting point material 107, and a bonding member 109. A diameter of the hole 111 bored in the rear plate is about 2 mm.

The low melting point material 107 is disposed between the conductive member 208 and the anode 104. The low melting point material improves conductivity by enhancing adhesion between the conductive member 208 and the anode 104. As a low melting point material, Sn—Pb solder (melting point 180 to 330° C.) of a low melting point metal material is used. The low melting point material is compressed and deformed between the conductive member 208 deformed by a atmospheric pressure and the anode 104, stuck to the surface shape of the conductive member 208 and the anode 104, and thus capable of improving electrical conductive reliability.

Further, when the image display apparatus 105 is influenced by an unexpected surrounding temperature to be deformed by thermal expansion, adhesion between the conductive member 208 and the anode 104 may be deteriorated. In such a case, by applying a high-frequency voltage to the conductive member 208, and generating heat to melt the low melting point material 107, it is possible to improve adhesion between the conductive member 208 and the anode 104 without disassembling the image display apparatus 105.

Vacuum airtightness is secured by using a bonding member 109 to bond the conductive member 208 and the anode 104. As a material of the bonding member 109, a frit which is low melting point glass is used. A mixture of a frit and a solvent is applied on the conductive member 208 by a dispenser, dried (120° C., 10 min.), and temporary burning (360° C., 10 min.) is carried out. Then, in a real burning step (420° C., 30 min.), the conductive member 208 is placed on the rear plate 102, and a load is applied on the conductive member 208 to crush the temporarily burned frit while a temperature is increased. Thus, good bonding is obtained.

The conductive member 208 is an integral member constituted of an adhesive portion of a diameter 4 mm and an elongation portion. A material is a 47% Ni—Fe alloy (thermal expansion coefficient $7.5\times10^{-6}$/° C. to $9\times10^{-6}$/° C.). It is roughly matched with thermal expansion of glass (thermal expansion coefficient $8.0\times10^{-6}$/° C. to $9.0\times10^{-6}$/° C.) used for the rear plate 102 to reduce thermal stress during manufacturing. The conductive member 208 is bonded to the rear plate 102 by the bonding member 109. Since only one place between the conductive member 208 and the rear plate 102 can be a bonded portion of the voltage supplying structure 100, it is possible to limit a probability of leakage or a strength reduction caused by bonding failures.

Figure 6A:
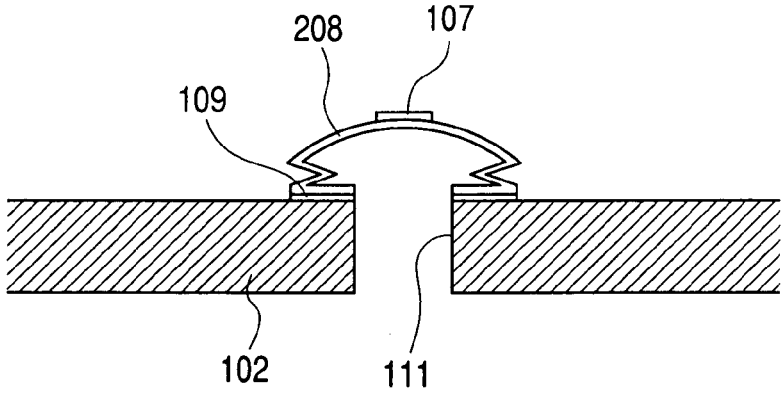
FIGS. 6A, 6B and 6C are process views showing a manufacturing method of the voltage supplying structure of the second embodiment.
Figure 6B:
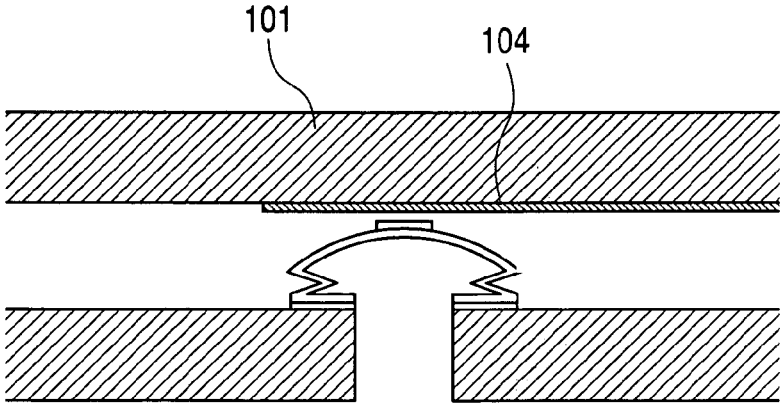
Figure 6C:
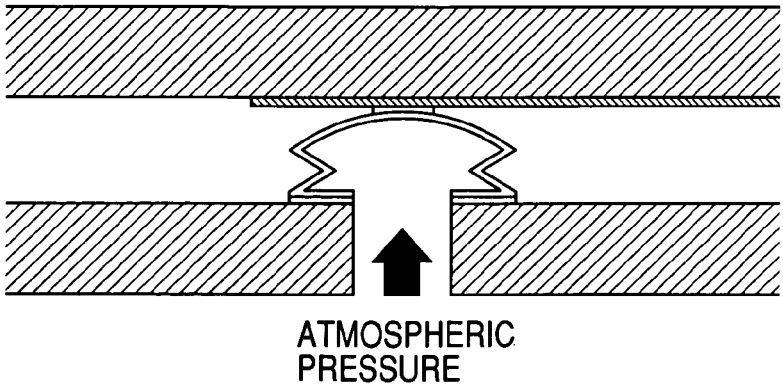

The conductive member 208 is manufactured by sucking a plate of 10 mm in diameter and 0.05 mm in thickness in a mold by air, and executing press-molding. A shape is a circle of an outer diameter of about 4 mm when the image display apparatus 105 is seen from the anode 104 side. A height is about 0.7 mm, which is smaller than a gap length 2 mm between the rear plate 102 and the face plate 101. As shown in FIG. 6A, the conductive member 208 is bonded to the rear plate 102 by the bonding member 109. Then, as shown in FIG. 6B, the frame 103 is pinched in between the rear plate 102 and the face plate 101, and the rear plate and the frame, and the frame and the rear plate are sealed from each other by frits. Then, a vacuum is drawn through the not-shown exhaust pipe between the rear plate 102 and the face plate 102, sealing is applied, and accordingly a vacuum container is manufactured. At this time as shown in FIG. 6C, the conductive member 208 is elongated to the gap length 2 mm between the rear plate 102 and the face plate 101 by an influence of an atmospheric pressure from the hole 111. Thus, it is possible to realize a shape to be made conductive with the anode 104 through the low melting point material 107.

In the conductive member 102, a plurality of concave and convex shapes can be formed in the elongation section on the side face by press-molding without much time and labor, and it is possible to control deformation of the conductive member 208 by the atmospheric pressure in a direction of the anode 104. As a result, it is possible to improve conductive reliability between the conductive member 208 and the anode 104. Furthermore, as the portion of the conductive member 208 bonded to the rear plate 102, a constitution is employed in which a surface opposite the surface bonded to the rear plate 102 by the bonding member 109 is exposed to an atmospheric pressure atmosphere as an external atmosphere, and a structure is employed in which the portion of the conductive member 208 bonded to the rear plate 102 is pressed by the atmospheric pressure to the rear plate 102 side as the bonding target. Thus, it is possible to improve vacuum airtightness of the bonded surface.

Example 3

A vacuum container and an image display apparatus of the embodiment are roughly similar to those of Example 1. However, the voltage supplying structure is changed to a structure shown in FIG. 7.

Figure 7:
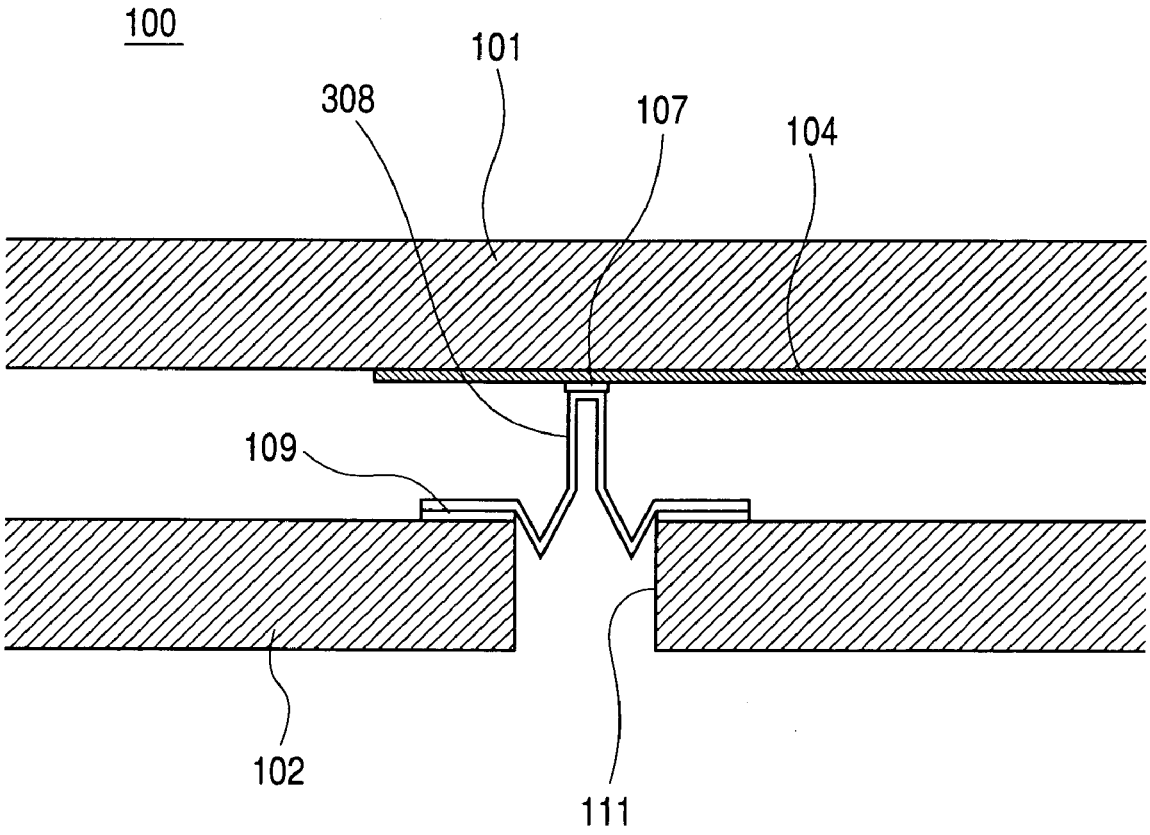
FIG. 7 is a schematic partial sectional view showing a voltage supplying structure of a third embodiment.

As a power supply mechanism from an atmosphere to the image display apparatus 105 which is vacuum inside, a voltage supplying structure 100 is provided. FIG. 7 is a sectional view of the third embodiment, which is equivalent to the line A—A portion of FIG. 1. A voltage is applied from the backside of a rear plate 102 through a hole 111 to a conductive member 308, and applied through a low melting point material 107 to an anode 104.

The voltage supplying structure 100 comprises the conductive member 308, the low melting point material 107, and a bonding member 109. A diameter of the hole 111 bored in the rear plate is about 2 mm.

The low melting point material 107 is disposed between the conductive member 308 and the anode 104. The low melting point material improves conductivity by enhancing adhesion between the conductive member 308 and the anode 104. As a low melting point material, an Sn—Cu alloy (melting point 200 to 350° C.) of a low melting point metal material is used. The low melting point material is compressed and deformed between the conductive member 308 deformed by an atmospheric pressure and the anode 104, stuck to the surface shape of the conductive member 308 and the anode 104, and thus capable of improving electrical conductive reliability.

Further, when the image display apparatus 105 is influenced by an unexpected surrounding temperature to be deformed by thermal expansion, adhesion between the conductive member 308 and the anode 104 may be deteriorated. In such a case, by applying a high-frequency voltage to the conductive member 308, and generating heat to melt the low melting point material 107, it is possible to improve adhesion between the conductive member 308 and the anode 104 without disassembling the image display apparatus 105.

Vacuum airtightness is secured by using a bonding member 109 to bond the conductive member 308 and the anode 104. As a material of the bonding member 109, a frit which is low melting point glass is used. A mixture of a frit and a solvent is applied on the conductive member 308 by a dispenser, dried (120° C., 10 min.), and temporary burning (360° C., 10 min.) is carried out. Then, in a real burning step (420° C., 30 min.), the conductive member 308 is placed on the rear plate 102, and a load is applied on the conductive member 308 to crush the temporarily burned frit while a temperature is increased. Thus, good bonding is obtained.

The conductive member 308 is an integral member constituted of an adhesive portion of a diameter 4 mm and an elongation portion. A material is a 47% Ni—Fe alloy (thermal expansion coefficient $8\times10^{-6}$/° C. to $9.5\times10^{-6}$/° C.). It is roughly matched with thermal expansion of glass (thermal expansion coefficient $8.0\times10^{-6}$/° C. to $9.0\times10^{-6}$/° C.) used for the rear plate 102 to reduce thermal stress during manufacturing. The conductive member 308 is bonded to the rear plate 102 by the bonding member 109. Since only one place between the conductive member 308 and the rear plate 102 can be a bonded portion of the voltage supplying structure 100, it is possible to limit a probability of leakage or a strength reduction caused by bonding failures.

Figure 8A:
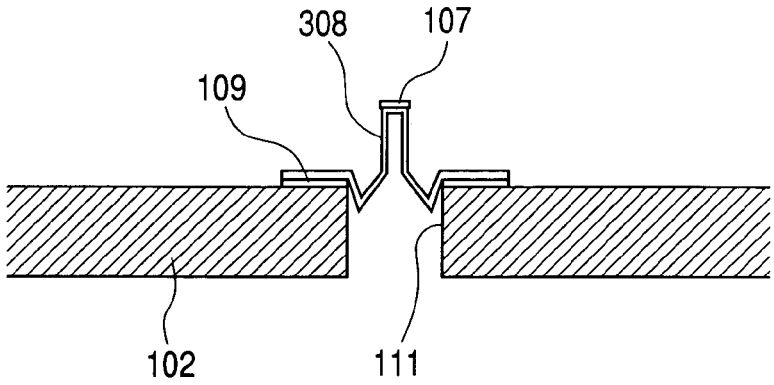
FIGS. 8A and 8B are process views showing a manufacturing method of the voltage supplying structure of the third embodiment.
Figure 8B:
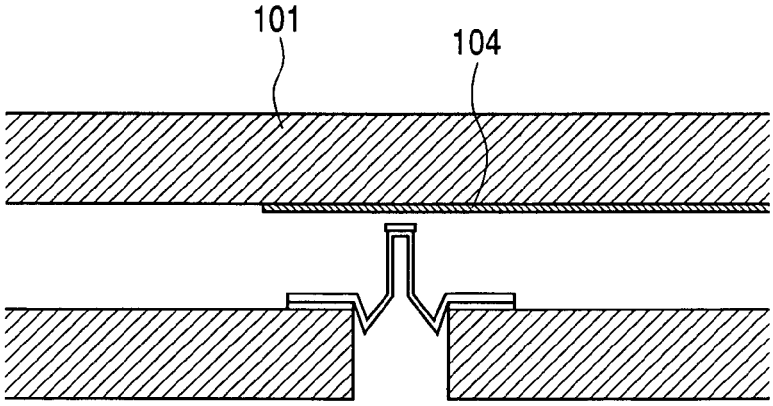
Figure 8C:
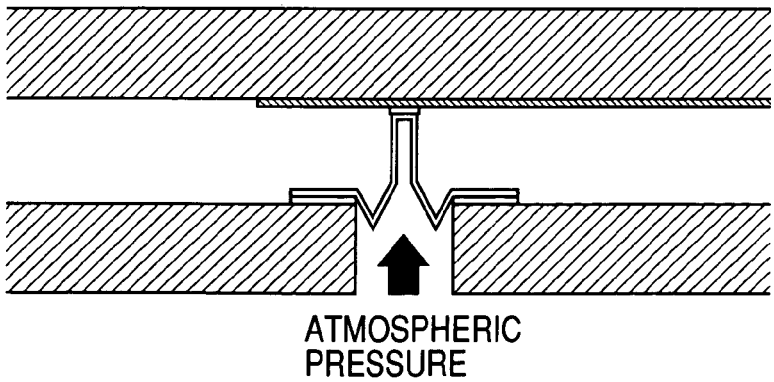

The conductive member 308 is manufactured by sucking a plate of 9 mm in diameter and 0.05 mm in thickness in a mold by air, and executing press-molding. A shape is a circle of an outer diameter of about 4 mm and a tip diameter of 0.5 mm when the image display apparatus 105 is seen from the anode 104 side. A height is about 1.5 mm, which is smaller than a gap length 2 mm between the rear plate 102 and the face plate 101. As shown in FIG. 8A, the conductive member 308 is bonded to the rear plate 102 by the bonding member 109. Then, as shown in FIG. 8B, the frame 103 is pinched in between the rear plate 102 and the face plate 101, and the rear plate and the frame, and the frame and the rear plate are sealed from each other by frits. Then, a vacuum is drawn through the not-shown exhaust pipe between the rear plate 102 and the face plate 102, sealing is applied, and accordingly a vacuum container is manufactured. At this time as shown in FIG. 8C, the conductive member 308 is elongated to the gap length 2 mm between the rear plate 102 and the face plate 101 by an influence of an atmospheric pressure from the hole 111. Thus, it is possible to realize a shape to be brought into contact with the anode 104 through the low melting point material 107.

Since a crushing area of the low melting point material 107 between the conductive member 308 and the anode 104 is reduced, it is possible to increase a pressure per unit on the low melting point material 107 applied by the atmospheric pressure. As a result, it is possible to improve conductive reliability between the conductive member 308 and the anode 104.

Example 4

A vacuum container and an image display apparatus of the embodiment are roughly similar to those of the Example 1. However, the voltage supplying structure is changed to a structure shown in FIG. 9.

Figure 9:
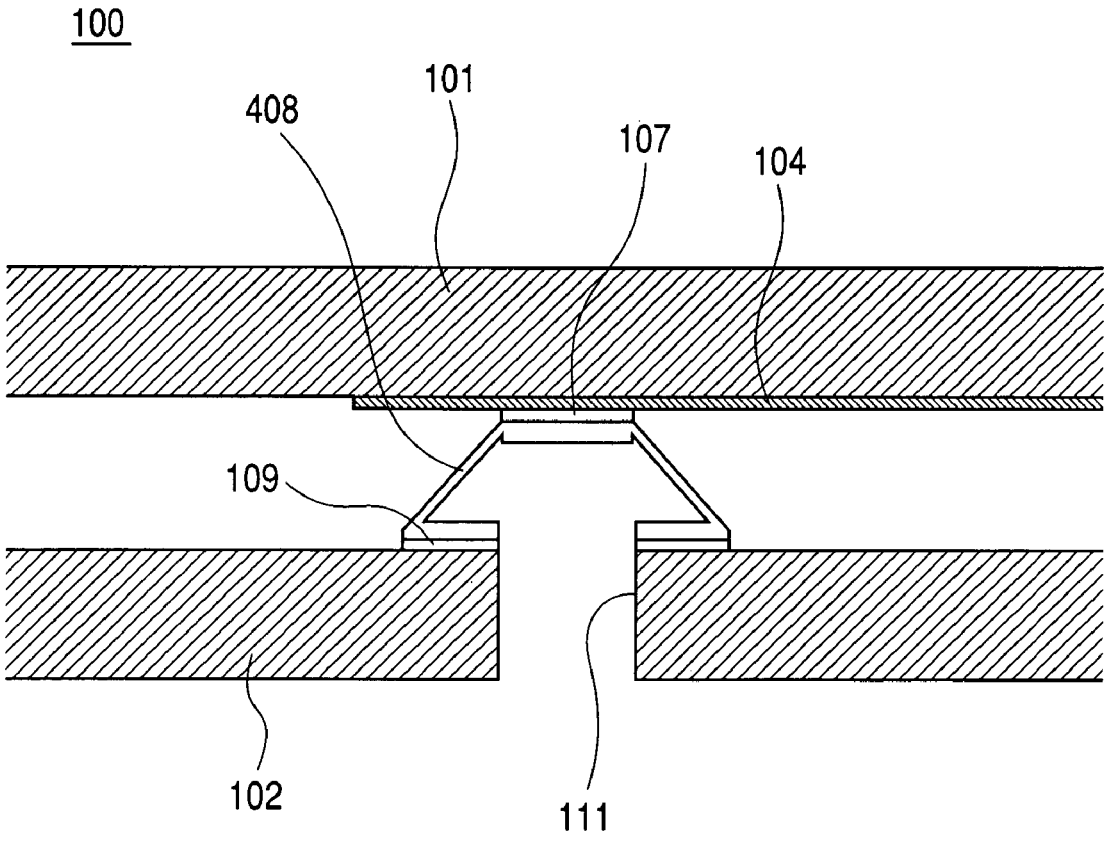
FIG. 9 is a schematic partial sectional view showing a voltage supplying structure of a fourth embodiment.

As a power supply mechanism from an atmosphere to the image display apparatus 105 which is vacuum inside, a voltage supplying structure 100 is provided. FIG. 9 is a sectional view of the second embodiment, which is equivalent to the line A—A portion of FIG. 1. A voltage is applied from the backside of a rear plate 102 through a hole 111 to a conductive member 408, and applied through a low melting point material 107 to an anode 104.

The voltage supplying structure 100 comprises the conductive member 408, the low melting point material 107, and a bonding member 109. A diameter of the hole 111 bored in the rear plate is about 2 mm.

The low melting point material 107 is disposed between the conductive member 408 and the anode 104. The low melting point material improves conductivity by enhancing adhesion between the conductive member 408 and the anode 104. As a low melting point material, an Sn—Ag alloy (melting point 200 to 350° C.) of a low melting point metal material is used. The low melting point material is compressed and deformed between the conductive member 408 deformed by a atmospheric pressure and the anode 104, stuck to the surface shape of the conductive member 408 and the anode 104, and thus capable of improving electrical conductive reliability.

Further, when the image display apparatus 105 is influenced by an unexpected surrounding temperature to be deformed by thermal expansion, adhesion between the conductive member 408 and the anode 104 may be deteriorated. In such a case, by applying a high-frequency voltage to the conductive member 408, and generating heat to melt the low melting point material 107, it is possible to improve adhesion between the conductive member 408 and the anode 104 without disassembling the image display apparatus 105.

Vacuum airtightness is secured by using a bonding member 109 to bond the conductive member 408 and the anode 104. As a material of the bonding member 109, a frit which is low melting point glass is used. A mixture of a frit and a solvent is applied on the conductive member 408 by a dispenser, dried (120° C., 10 min.), and temporary burning (360° C., 10 min.) is carried out. Then, in a real burning step (420° C., 30 min.), the conductive member 408 is placed on the rear plate 102, and a load is applied on the conductive member 408 to crush the temporarily burned frit while a temperature is increased. Thus, good bonding is obtained.

The conductive member 408 is an integral member constituted of an adhesive portion of a diameter 4 mm and an elongation portion. A material is a an Fe—Ni—Co alloy (thermal expansion coefficient $7.5\times10^{-6}$/° C. to $9.8\times10^{-6}$/° C.). It is roughly matched with thermal expansion of glass (thermal expansion coefficient $8.0\times10^{-6}$/° C. to $9.0\times10^{-6}$/° C.) used for the rear plate 102 to reduce thermal stress during manufacturing. The conductive member 408 is bonded to the rear plate 102 by the bonding member 109. Since only one place between the conductive member 408 and the rear plate 102 can be a bonded portion of the voltage supplying structure 100, it is possible to limit a probability of leakage or a strength reduction caused by bonding failures.

Figure 10A:
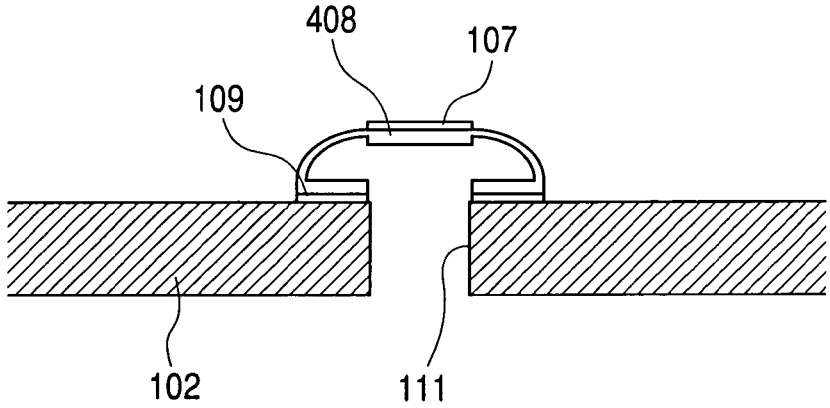
FIGS. 10A, 10B and 10C are process views showing a manufacturing method of the voltage supplying structure of the fourth embodiment.
Figure 10B:
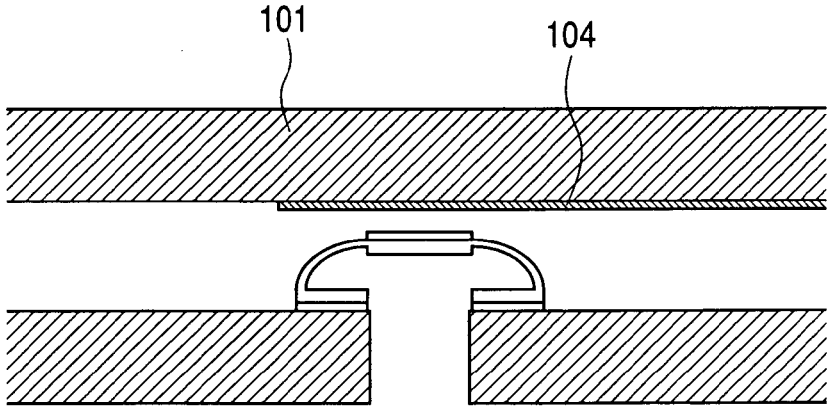
Figure 10C:
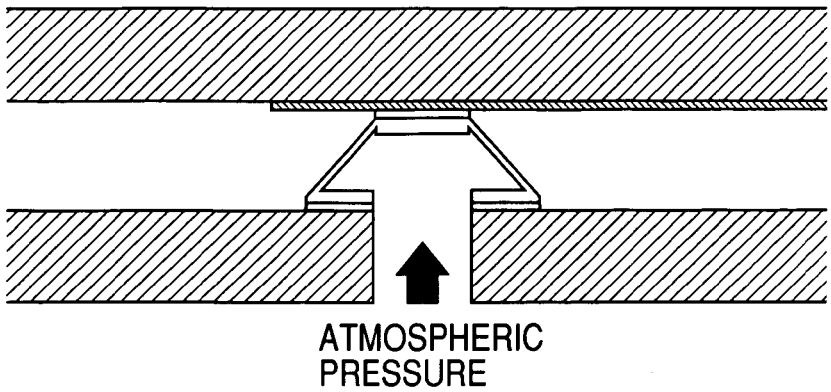
Figure 11:
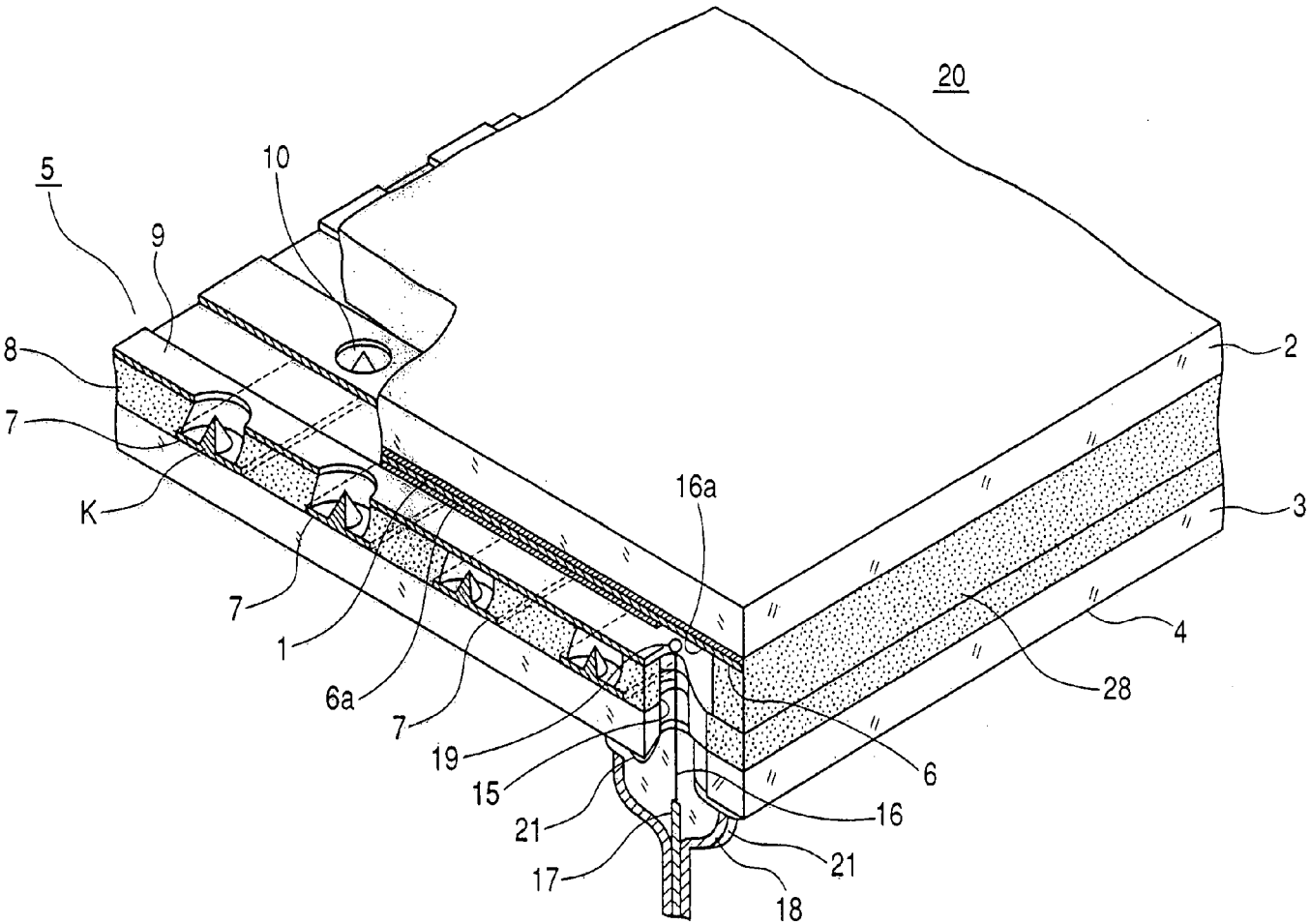
PRIOR ART FIG. 11
FIG. 11 is a schematic view showing a conventional image display apparatus.

The conductive member 408 is manufactured by sucking a plate of about 10 mm in diameter and 0.1 mm in thickness in a mold by air, and executing press-molding. A shape is a circle of an outer diameter of about 4 mm when the image display apparatus 105 is seen from the anode 104 side. A height is about 0.6 mm, which is smaller than a gap length 2 mm between the rear plate 102 and the face plate 101. As shown in FIG. 10A, the conductive member 408 is bonded to the rear plate 102 by the bonding member 109. Then, as shown in FIG. 10B, the frame 103 is pinched in between the rear plate 102 and the face plate 101, and the rear plate and the frame, and the frame and the rear plate are sealed from each other by frits. Then, a vacuum is drawn through the not-shown exhaust pipe between the rear plate 102 and the face plate 102, sealing is applied, and accordingly a vacuum container is manufactured. At this time as shown in FIG. 10C, the conductive member 408 is elongated to the gap length 2 mm between the rear plate 102 and the face plate 101 by an influence of an atmospheric pressure from the hole 111. Thus, it is possible to realize a shape to be made conductive with the anode 104 through the low melting point material 107.

Since the conductive member 408 is formed in the circular in an in-plane direction of the rear plate 102, a uniform atmospheric pressure is generated on the circle, and it is possible to control deformation of the conductive member 408 in a direction of the anode 104. As a result, it is possible to improve conductive reliability between the conductive member 408 and the anode 104. Furthermore, since a structure is employed in which the surface of the conductive member 408 to the rear plate 102 by the bonding member 109 is pressed by the atmospheric pressure, it is possible to improve vacuum airtightness of the bonded surface.

What is claimed is:

1. A method for manufacturing an airtight container having a space in which a pressure is lower than an outside pressure, between opposing first and second substrates, comprising steps of:

assembling the container having a space between the first substrate on which an electrode is disposed on a surface to be facing the space and the second substrate which has a structure for supplying a potential to the electrode; and applying a pressure difference between inside and outside of the container assembled in the assembling step, wherein in the container before the applying step, the structure has a concave portion which is opened to an external atmosphere at a through-hole penetrating the second substrate and closed at a bottom of the concave portion, having electrical conductivity, and wherein the pressure difference is brought in the applying step to elongate lengths of the structure in a direction in which the first and second substrates are opposed to each other, whereby the structure is formed in a shape to enable supplying of a potential to the electrode through the bottom of the structure.

2. The method according to claim 1, wherein a portion of the structure to be brought into direct or indirect contact with the electrode and a portion of the structure to be deformed are formed by bending one plate member.

3. The method according to claim 2, wherein the portion of the structure to be brought into direct or indirect contact with the electrode, the portion of the structure to be deformed, and the portion of the structure bonded to the second substrate are formed by bending one plate member.

4. A method for manufacturing an image display apparatus, comprising the steps of:

manufacturing the airtight container according to the method of claim 1; and providing an image display device inside of the airtight container.

5. A method for manufacturing an airtight container having a space in which a pressure is lower than an outside pressure, between opposing first and second substrates, comprising steps of:

assembling the container having a space between the first substrate on which an electrode is disposed on a surface to be facing the space and the second substrate which has a structure for supplying a potential to the electrode; and applying a pressure difference between inside and outside of the container assembled in the assembling step, wherein in the container before the applying step, the structure has a concave portion which is opened to an external atmosphere at a through-hole penetrating the second substrate and closed at a bottom of the concave portion, having electrical conductivity, and wherein the pressure difference is brought in the applying step to elongate lengths of the structure in a direction in which the first and second substrates are opposed to each other, whereby the structure is formed in a shape to enable supplying of a potential to the electrode through the structure, wherein by bringing said pressure difference, said bottom of the concave portion is brought directly into contact with said electrode, said bottom of the concave portion is brought into contact with said electrode through a metal being more pliable than said electrode, or said bottom of the concave portion is brought into contact with said electrode through a conductive adhesive.

* * * * *